US009988238B2

(12) United States Patent
Simcik et al.

(10) Patent No.: US 9,988,238 B2
(45) Date of Patent: Jun. 5, 2018

(54) ELEVATOR DISPATCH USING FACIAL RECOGNITION

(71) Applicant: OTIS ELEVATOR COMPANY, Farmington, CT (US)

(72) Inventors: Paul A. Simcik, Southington, CT (US); Bradley Armand Scoville, Terryville, CT (US); Eric C. Peterson, East Longmeadow, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 63 days.

(21) Appl. No.: 14/914,163

(22) PCT Filed: Sep. 3, 2013

(86) PCT No.: PCT/US2013/057800
§ 371 (c)(1),
(2) Date: Feb. 24, 2016

(87) PCT Pub. No.: WO2015/034459
PCT Pub. Date: Mar. 12, 2015

(65) Prior Publication Data

US 2016/0214830 A1 Jul. 28, 2016

(51) Int. Cl.
*B66B 1/34* (2006.01)
*B66B 1/46* (2006.01)

(52) U.S. Cl.
CPC ..... *B66B 1/468* (2013.01); *B66B 2201/4615* (2013.01); *B66B 2201/4638* (2013.01); *B66B 2201/4661* (2013.01)

(58) Field of Classification Search
CPC ..... B66B 1/468; B66B 2201/4615; B66B 2201/4638; B66B 2201/4661
(Continued)

(56) References Cited

U.S. PATENT DOCUMENTS 6,772,862 B2 8/2004 Friedli
7,620,817 B2 11/2009 Friedli et al.
(Continued)

FOREIGN PATENT DOCUMENTS

CN 101506077 A 8/2009
JP 2005132549 A 5/2005
(Continued)

OTHER PUBLICATIONS

International Search Report for application PCT/US2013/057800 dated Apr. 24, 2014, 5 pages.
(Continued)

*Primary Examiner* — Anthony Salata
(74) *Attorney, Agent, or Firm* — Cantor Colburn LLP

(57) ABSTRACT

A conveyance system includes a camera to generate an image of an area of interest; a dispatch system including a facial recognition unit and a profile unit, the facial recognition unit detecting facial features of a user in the image; the dispatch system determining if the facial features match a profile stored in the profile unit, the dispatch system scheduling car service in response to the facial features matching the profile stored in the profile unit; a system interface including a system interface camera, the system interface camera to generate a second image of the user at the system interface; the facial recognition unit detecting facial features of the user in the second image; the dispatch system determining if the facial features of the user in the second image match the profile stored in the profile unit.

15 Claims, 4 Drawing Sheets

(58) Field of Classification Search
USPC ..... 187/247, 380–388, 391, 392, 393; 382/115, 118, 162
See application file for complete search history.

(56) References Cited

U.S. PATENT DOCUMENTS

| | | | | |
|---|---|---|---|---|
| 8,020,672 | B2 * | 9/2011 | Lin | B66B 1/34 187/316 |
| 8,061,485 | B2 * | 11/2011 | Finschi | B66B 1/468 187/384 |
| 8,260,042 | B2 * | 9/2012 | Peng | B66B 5/0012 382/115 |
| 8,381,880 | B2 | 2/2013 | Finschi | |
| 8,490,754 | B2 * | 7/2013 | Amano | B66B 1/2458 187/384 |
| 8,813,917 | B2 * | 8/2014 | Salmikuukka | B66B 1/468 187/247 |
| 8,857,569 | B2 * | 10/2014 | Friedli | B66B 5/0012 187/384 |
| 8,910,752 | B2 * | 12/2014 | Furutani | B66B 1/468 187/384 |
| 9,238,568 | B2 * | 1/2016 | Nonami | B66B 1/468 |
| 2009/0208067 | A1 | 8/2009 | Peng et al. | |
| 2012/0234631 | A1 | 9/2012 | Hsieh | |
| 2015/0151947 | A1 * | 6/2015 | Kuroda | B66B 1/468 187/380 |
| 2015/0183618 | A1 * | 7/2015 | Kondo | B66B 1/468 187/380 |
| 2015/0314983 | A1 * | 11/2015 | Saari | B66B 1/468 187/382 |
| 2015/0329316 | A1 * | 11/2015 | Lee | B66B 1/2408 187/384 |
| 2016/0090270 | A1 * | 3/2016 | Wang | B66B 1/468 187/388 |
| 2016/0311646 | A1 * | 10/2016 | Bryant | G06K 9/00288 |
| 2017/0144859 | A1 * | 5/2017 | Scoville | G06F 3/017 |
| 2017/0210594 | A1 * | 7/2017 | Gerstenmeyer | B66B 1/2458 |

FOREIGN PATENT DOCUMENTS

| | | | |
|---|---|---|---|
| JP | 2006137572 | A | 6/2006 |
| JP | 2008044711 | A | 2/2008 |
| JP | 2008120549 | A | 5/2008 |
| JP | 2008127158 | A | 6/2008 |

OTHER PUBLICATIONS

Written Opinion for application PCT/US2013/057800 dated Apr. 24, 2014, 8 pages.
Chinese Office Action and Search Report for application 201380079344.X, dated Mar. 30, 2017 6pgs.
European Search Report for application 13892938.5, dated May 2, 2017, 7 pgs.

* cited by examiner

| Day of Week | Time of Day | Current location | Anticipated destination | |
|---|---|---|---|---|
| M-F | 7AM-9AM | Lobby | Floor 21 | |
| M-F | 5PM-7PM | Floor 21 | Lobby | |
| M-F | 11:30 AM-12PM | Floor 21 | Cafeteria | |
| M-F | 12:30 PM-1:30PM | Cafeteria | Floor 21 | |

FIG. 3

ELEVATOR DISPATCH USING FACIAL RECOGNITION

BACKGROUND

The subject matter disclosed herein relates to conveyance systems, such as elevator systems. More specifically, the subject matter disclosed herein relates to an elevator system that uses facial recognition to control elevator dispatching.

Elevator systems can use a variety of techniques to allow a user to request elevator service. In traditional systems, users provide an up or down hall call, and then enter a floor destination upon entering the elevator car. Other existing systems allow a user to enter a destination call at a kiosk, the destination call specifying a particular floor. Other existing systems read a user identifier, such as an employee badge, to determine a destination floor.

SUMMARY

An exemplary embodiment is a conveyance system including a camera to generate an image of an area of interest; a dispatch system including a facial recognition unit and a profile unit, the facial recognition unit detecting facial features of a user in the image; the dispatch system determining if the facial features match a profile stored in the profile unit, the dispatch system scheduling car service in response to the facial features matching the profile stored in the profile unit; a system interface including a system interface camera, the system interface camera to generate a second image of the user at the system interface; the facial recognition unit detecting facial features of the user in the second image; the dispatch system determining if the facial features of the user in the second image match the profile stored in the profile unit; the system interface requesting a destination from the user when the facial features of the user in the second image do not match the profile stored in the profile unit; the system interface presenting an anticipated destination from the profile when the facial features of the user in the second image match the profile stored in the profile unit.

Another exemplary embodiment is a method for operating a conveyance system, the method including generating an image of an area of interest; detecting facial features of a user in the image; determining if the facial features match a profile; scheduling conveyance service in response to the facial features matching the profile; generating a second image of the user at a system interface; detecting facial features of the user in the second image; determining if the facial features of the user in the second image match the profile stored; requesting a destination from the user when the facial features of the user in the second image do not match the profile; presenting an anticipated destination from the profile when the facial features of the user in the second image match the profile stored in the profile unit.

Another exemplary embodiment is a computer program product, tangibly embodied on a non-transitory computer readable medium, for operating a conveyance system, the computer program product including instructions that, when executed by a computer, cause the computer to perform operations including: generating an image of an area of interest; detecting facial features of a user in the image; determining if the facial features match a profile; scheduling conveyance service in response to the facial features matching the profile; generating a second image of the user at a system interface; detecting facial features of the user in the second image; determining if the facial features of the user in the second image match the profile stored; requesting a destination from the user when the facial features of the user in the second image do not match the profile; and presenting an anticipated destination from the profile when the facial features of the user in the second image match the profile stored in the profile unit.

These and other advantages and features will become more apparent from the following description taken in conjunction with the drawings.

BRIEF DESCRIPTION OF THE DRAWINGS

FIG. 3 depicts a user profile in an exemplary embodiment; and

The detailed description explains embodiments of the invention, together with advantages and features, by way of example with reference to the drawings.

DETAILED DESCRIPTION

Figure 1:
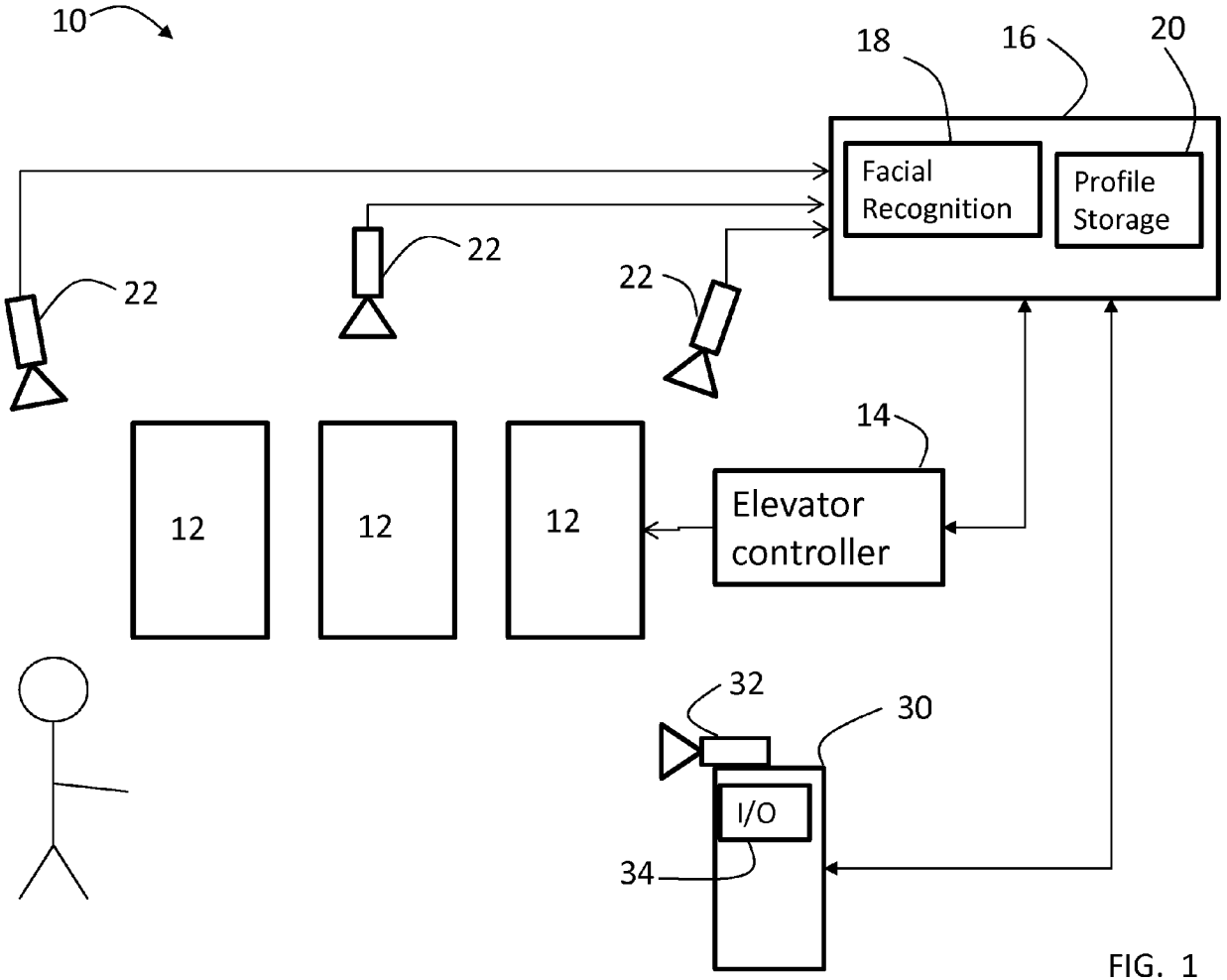
FIG. 1 depicts an elevator system in an exemplary embodiment.

FIG. 1 illustrates an elevator system 10 in an exemplary embodiment. Elevator system 10 includes a plurality of elevator cars 12. Elevator cars 12 are controlled by an elevator controller 14. Elevator controller 14 is responsible for dispatching elevator cars 12 to appropriate floors in a building. Elevator controller 14 may receive destination commands from a dispatch system 16, as described in further detail herein. Dispatch system 16 may be implemented using a microprocessor based device (e.g., computer, server) executing a computer program stored in a memory to perform the functions described herein. Alternatively, the dispatch system 16 may be implemented in hardware (e.g., ASIC) or in a combination of hardware and software. The dispatch system 16 may be implemented using an existing elevator management system in an elevator system. Alternatively, the dispatch system 16 may be implemented as add-on hardware/software to an existing elevator management system or be part of a separate building management system. In other embodiments, dispatch system 16 is part of elevator controller 14. In other embodiments, the functions provided by dispatch system 16 may be implemented by one or more remotely located system(s) (e.g., remote server, cloud computing system). Dispatch system 16 may generate destination commands (e.g., hall calls and/or destination calls) that are provided to elevator controller 14. Elevator controller 14 processes the destination commands in the same manner as calls from other sources (e.g., hall buttons, destination kiosks).

As described herein, the dispatch system 16 obtains an anticipated destination for a user based on facial recognition. Dispatch system 16 includes a facial recognition unit 18 and a profile storage unit 20. Facial recognition unit 18 may be implemented by software executing on dispatch system 16. Profile storage unit 20 may be implemented by a database stored in memory on dispatch system 16. Operation of the facial recognition unit 18 and the profile storage unit 20 are described in further detail herein. While the dispatch system 16 is shown including the facial recognition unit 18 and the profile storage unit 20, one or both of these units, or the functions provided by these units, may be implemented by one or more system(s) (e.g., remote server, cloud computing system) remotely located from dispatch system 16.

A plurality of cameras 22 are directed to an area adjacent the elevator cars 12, such as a building lobby or along an access route to the elevators. Cameras 22 may be dispersed at various locations so as to acquire images from multiple viewpoints (i.e. simultaneous views of the user to provide more detection opportunities). They may also positioned at different locations so as to acquire images from multiple positions with respect to the elevators to provide motion estimation of a particular user. Providing images of users from multiple viewpoints simplifies the facial recognition, as it is more likely to acquire a view corresponding to existing feature profile(s) of each user. This allows cameras 22 to be lower resolution and lower cost.

A system interface 30 includes a system interface camera 32 for acquiring images of users positioned at the system interface 30. System interface 30 may be a kiosk (e.g., in the building lobby) or a wall mounted unit (e.g., at a floor landing). System interface 30 may be implemented using a microprocessor based device (e.g., computer, server) executing a computer program stored in a memory to perform the functions described herein. Alternatively, the system interface 30 may be implemented in hardware (e.g., ASIC) or in a combination of hardware and software. An input/output unit 34 is used to present information to users and receive commands from users. Input/output unit 34 may be implemented using a touchscreen, a display with peripherals (e.g., buttons, mouse, microphone, speaker), or other known input/output devices.

Figure 2:
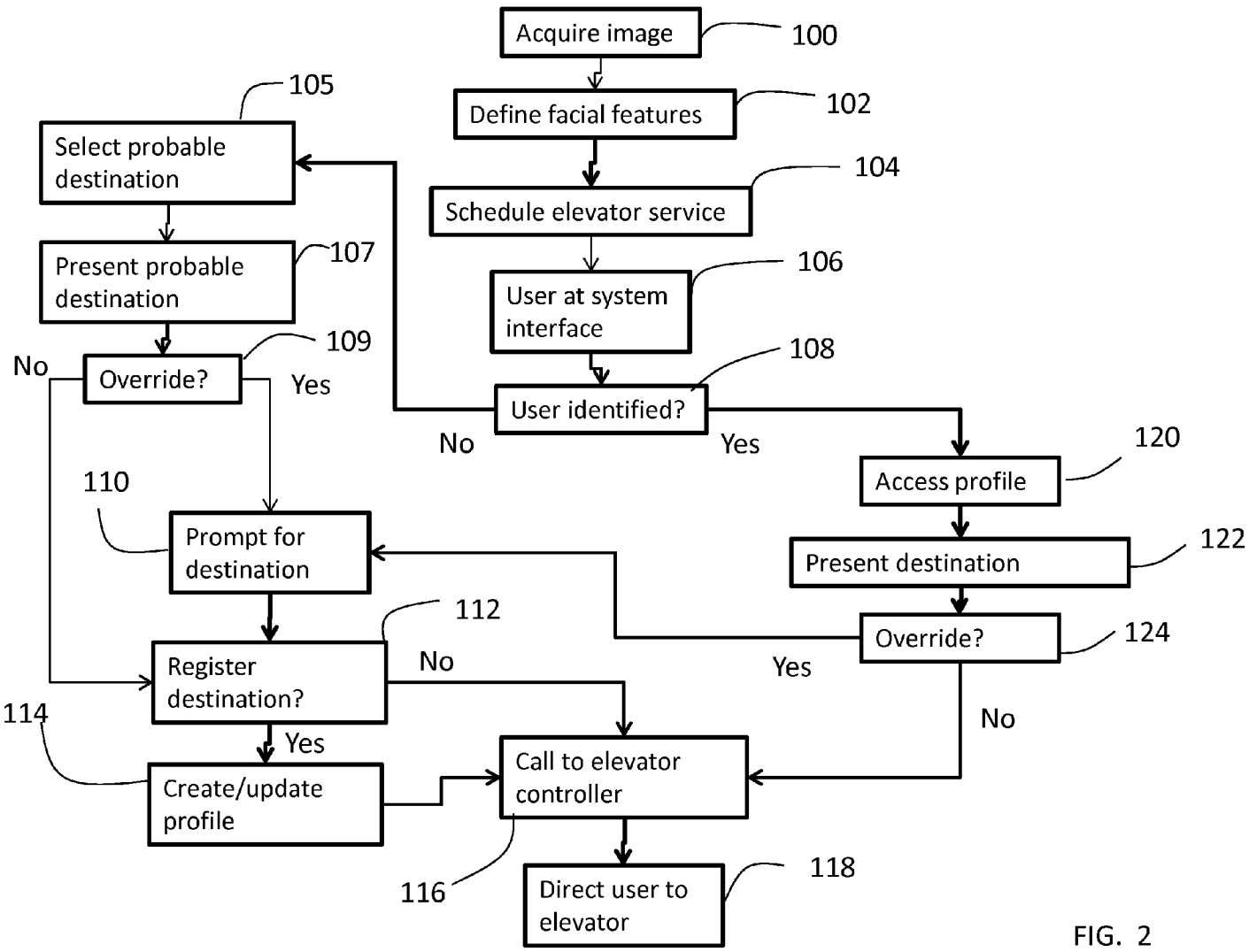
FIG. 2 depicts a process for dispatching elevator cars in an exemplary embodiment.

FIG. 2 is flowchart of a process for dispatching elevators in an exemplary embodiment. The process begins at 100 where cameras 22 obtain images of users in an area of interest (e.g., lobby) of a building. Cameras 22 are located to provide multiple viewpoints of the area of interest so that a recognizable view of each user is more likely to be obtained. As images are acquired, facial recognition is performed by facial recognition unit 18 at 102 to extract facial features for users. Images from cameras 22 may be processed separately so that an individual's facial features may be detected more than once. If this occurs, duplicate facial recognition events are ignored.

The processing at 102 can also detect direction of travel of a user, based on the viewpoints of cameras 22. User movement may be tracked in the area of interest to determine if a user is heading towards elevators 12 or heading away from elevators 12. Detection of facial features may be limited to users approaching the cameras 22 based on direction of travel.

At 104, elevator service is scheduled for any users heading towards the elevators 12 and having an already existing profile in profile storage 20. User profiles in profile unit 20 may be indexed by facial features generated by facial recognition unit 18. FIG. 3 shows an exemplary profile that includes day of week, time of day, current location and anticipated destination. Based on the day of week, time of day and current location, dispatch system 16 can determine an anticipated destination for the user. The anticipated destination is shown as a particular floor, but may also be represented as up or down. Using the anticipated destinations, dispatch unit 16 can begin to schedule elevator service. This includes determining the number of cars that will be needed, which car each user will ride, what floors each car will stop at, etc.

At 106, the user arrives at the system interface 30. System interface camera 32 acquires a second image of the user and facial recognition is used to recognize the user. System interface 30 may be equipped with a facial recognition unit, or the second image from system interface camera 32 may be routed to the dispatch system 16 for facial recognition.

At 108, the facial features of the user at the system interface 30 are compared to facial features in profile storage unit 20 to identify the user and associated the user with a profile. If the user is not identified at 108, flow proceeds to 105 where a probable destination is determined by dispatch system 16. The probable destination may be based on time of day, location of the user, historical elevator usage data, events scheduled in the building for that day/time, etc. At 107, the probable destination is presented to user through the system interface 30. For example, system interface 30 may present a prompt with the probable destination (e.g., "Are you heading to the seminar on floor 30?"). At 109, the user can override the probable destination and enter a different destination. If no override is received within a certain period of time (e.g., 3 seconds) or if the user expressly accepts the destination through system interface 30, flow proceeds to 112.

If the user overrides the probable destination at 109, flow proceeds to 110 where the system interface 30 prompts the user for a destination. The user enters a destination through the input/output unit 34. The destination may be a specific floor or an indication of up or down. At 112, from either the negative branch of 109 or from 110, the system interface 30 prompts the user to register the destination. If the user selects yes, then at 114 a profile is created in profile storage unit 20 for the user including the user facial features, the user current location, the day of week, time of day and the destination floor and flow proceeds to 116. At 112, if the user declines to register the destination, flow proceeds directly to 116. In another embodiment, the user may be directed to building security to create a user profile.

At 116, an elevator call is created based on the destination entered at 110. The elevator call is an actual command for the elevator controller 14 to provide a car from one floor to another (in the event the destination specifies a floor) or to provide a car for travel in a certain direction (in the event the destination specifies up or down). At 118, the user is directed to the appropriate elevator car 12 through the input/output unit 34 (e.g., please proceed to car A).

Figure 4:
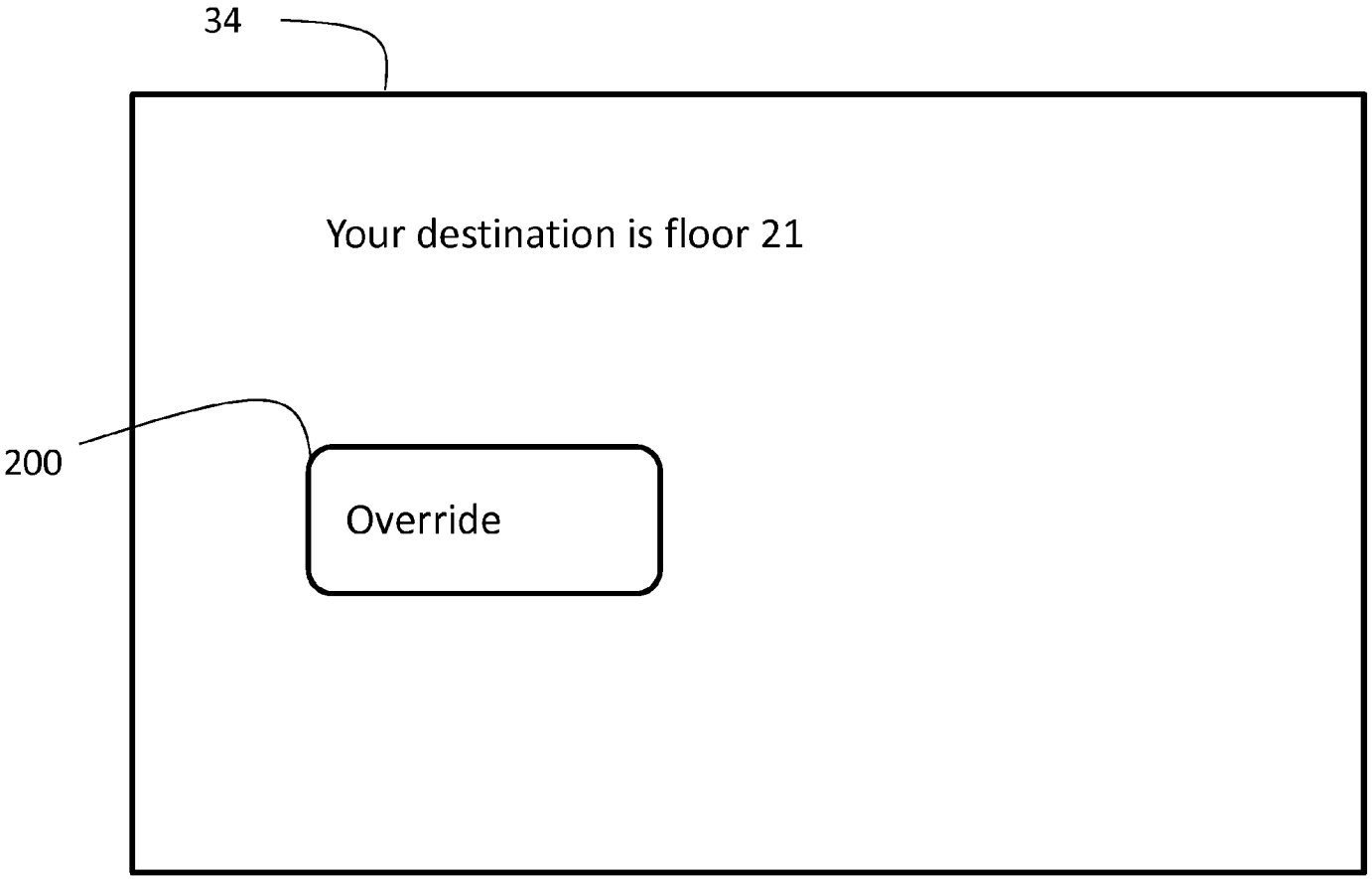
FIG. 4 depicts a system interface in an exemplary embodiment.

If at 108, the user is identified, flow proceeds to 120 where the user profile is accessed from profile storage unit 20. At 122, the anticipated destination is determined based on one or more of the user current location, day of week and time of day and the anticipated destination is presented to the user on the input/output unit 34. FIG. 4 depicts an exemplary message presented to the user indicating the anticipated destination. An override icon 200 is also presented to the user, if the user does not wish to travel to the anticipated destination.

At 124, if the user does not override the anticipated destination within a certain period of time (e.g., 3 seconds) or if the user expressly accepts the destination through system interface 30, flow proceeds to 116 where an elevator call is created based on the anticipated destination in the user profile. At 118, the user is directed to the appropriate elevator car 12 through the input/output unit 34 (e.g., please proceed to car A).

If at 124, the user elects to override the anticipated destination, flow proceeds to 110, where the user is prompted for a destination. Flow proceeds as described above, with the user provided an option to register the destination at 112. If a user with an existing profile registers a destination, their profile is updated with the new destination at 114.

The embodiments described above relate to a lobby, but similar systems may be employed at each landing. One or more cameras 22 may be installed at each landing and positioned to capture users approaching the elevator door(s). Each landing includes a system interface 30, which may be in the form of a wall mounted device, rather than a kiosk. Processing similar to that disclosed with reference to FIG. 2 may be performed for users at each landing.

The above embodiments refer to a user specifying that a destination be stored in their profile. Dispatch system 16 may also learn user patterns, and update the user profile automatically. For example, if every Friday a user travels to the lobby at lunchtime rather that the cafeteria floor, dispatch system 16 can learn this behavior and update the user profile accordingly. Of course, the user would be provided the option to override the anticipated destination as described above. When the user overrides an anticipated destination, the system may provide a list of recent manual destination requests based on travel of that user and/or the system may present a list of popular destination floors in the building In certain applications, it may be desirable to erase profiles to reduce storage demand on profile storage unit 20 and reduce the number of profiles that need to be searched in attempting to match facial features to a profile. In a hotel, for example, profiles more than 2 weeks old measured from a creation date, can be deleted as there is a low likelihood that a guest at the hotel will remain longer than two weeks. Profiles may also be deleted a time period (e.g., 24 hours) after a user checks out of a hotel. Further, profiles that have not been matched to user for a predetermined period of time (e.g., a month) may be deleted, as this indicates the user is no longer visiting the building.

Embodiments described herein are directed to an elevator system dispatching elevator cars. Embodiments may also include other types of transportation (train, subway, monorail, etc.) and thus embodiments may be generally applied to conveyance systems which dispatch cars.

As described above, exemplary embodiments can be in the form of processor-implemented processes and devices for practicing those processes, such as dispatch system 16. The exemplary embodiments can also be in the form of computer program code containing instructions embodied in tangible media, such as floppy diskettes, CD ROMs, hard drives, or any other computer-readable storage medium, wherein, when the computer program code is loaded into and executed by a computer, the computer becomes a device for practicing the exemplary embodiments. The exemplary embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the exemplary embodiments. When implemented on a general-purpose microprocessor, the computer program code segments configure the microprocessor to create specific logic circuits.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A conveyance system comprising:

a camera to generate an image of an area of interest;

a dispatch system including a facial recognition unit and a profile unit, the facial recognition unit detecting facial features of a user in the image;

the dispatch system determining if the facial features match a profile stored in the profile unit, the dispatch system scheduling car service in response to the facial features matching the profile stored in the profile unit;

a system interface including a system interface camera, the system interface camera to generate a second image of the user at the system interface;

the facial recognition unit detecting facial features of the user in the second image;

the dispatch system determining if the facial features of the user in the second image match the profile stored in the profile unit;

the system interface requesting a destination from the user when the facial features of the user in the second image do not match the profile stored in the profile unit;

the system interface presenting an anticipated destination from the profile when the facial features of the user in the second image match the profile stored in the profile unit.

2. The conveyance system of claim 1 wherein:

when the facial features of the user in the second image do not match the profile stored in the profile unit, the system interface prompts the user to register the destination.

3. The conveyance system of claim 2 wherein:

when the user confirms to register the destination, the system interface initiates creation of a new profile for the user.

4. The conveyance system of claim 3 wherein:

the new profile includes the facial features of the user and the destination as an anticipated destination.

5. The conveyance system of claim 1 wherein:

when the facial features of the user in the second image match the profile stored in the profile unit, the system interface prompts the user to override the anticipated destination.

6. The conveyance system of claim 1 wherein:

when the user overrides the anticipated destination, the system interface requests a destination from the user.

7. The conveyance system of claim 1 wherein:

the dispatch system initiates a car call to a controller in response to the destination.

8. The conveyance system of claim 1 wherein:

the dispatch system initiates a car call to a controller in response to the anticipated destination.

9. The conveyance system of claim 1 wherein:

the dispatch system deletes the profile after a period of time.

10. The conveyance system of claim 1 wherein:

the scheduling car service includes scheduling elevator car service.

11. The conveyance system of claim 1 wherein:

when the facial features of the user in the second image do not match the profile stored in the profile unit, the dispatch system determines a probable destination;

the system interface presenting the probable destination to the user.

12. The conveyance system of claim 11 wherein:

the dispatch system determines the probable destination in response to at least one of time of day, user location, scheduled events and historical usage of the conveyance system.

13. The conveyance system of claim 11 wherein:

when the user overrides the probable destination, the system interface requests a destination from the user.

14. A method for operating a conveyance system, the method comprising:

generating an image of an area of interest;

detecting facial features of a user in the image;

determining if the facial features match a profile;

scheduling conveyance service in response to the facial features matching the profile;

generating a second image of the user at a system interface;

detecting facial features of the user in the second image;

determining if the facial features of the user in the second image match the profile stored;

requesting a destination from the user when the facial features of the user in the second image do not match the profile; and presenting an anticipated destination from the profile when the facial features of the user in the second image match the profile stored in the profile unit.

15. A computer program product, tangibly embodied on a non-transitory computer readable medium, for operating a conveyance system, the computer program product including instructions that, when executed by a computer, cause the computer to perform operations comprising:

generating an image of an area of interest;

detecting facial features of a user in the image;

determining if the facial features match a profile;

scheduling conveyance service in response to the facial features matching the profile;

generating a second image of the user at a system interface;

detecting facial features of the user in the second image;

determining if the facial features of the user in the second image match the profile stored;

requesting a destination from the user when the facial features of the user in the second image do not match the profile;

presenting an anticipated destination from the profile when the facial features of the user in the second image match the profile stored in the profile unit.

* * * * *